US009266341B2

(12) United States Patent
Tsujiuchi et al.

(10) Patent No.: US 9,266,341 B2
(45) Date of Patent: Feb. 23, 2016

(54) LIQUID TANK HOLDING MECHANISM

(71) Applicant: CANON KABUSHIKI KAISHA, Tokyo (JP)

(72) Inventors: Naoko Tsujiuchi, Kawasaki (JP); Satoshi Kimura, Kawasaki (JP); Kyosuke Toda, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/716,259

(22) Filed: May 19, 2015

(65) Prior Publication Data

US 2015/0343785 A1 Dec. 3, 2015

(30) Foreign Application Priority Data

May 30, 2014 (JP) ..... 2014-112190

(51) Int. Cl.
*B41J 2/175* (2006.01)

(52) U.S. Cl.
CPC ..... *B41J 2/1752* (2013.01); *B41J 2/17553* (2013.01)

(58) Field of Classification Search
CPC ..... B05C 11/10; B05C 5/00; B41J 2/175; B41J 2/1752; B41J 2/17553
See application file for complete search history.

(56) References Cited

U.S. PATENT DOCUMENTS 8,376,536 B2 * 2/2013 Nakamura ..... B41J 2/17513 347/86

FOREIGN PATENT DOCUMENTS

JP 2008-110577 A 5/2015

* cited by examiner

*Primary Examiner* — Sarah Al Hashimi
(74) *Attorney, Agent, or Firm* — Fitzpatrick, Cella, Harper & Scinto

(57) ABSTRACT

A liquid tank holding mechanism for detachably holding a liquid tank to a main body portion includes a biasing member, a cover and a lever, wherein: the biasing member biases the liquid tank in a disengaging direction with the liquid tank mounted; the lever includes a lock, a biasing portion, a shaft, and a retainer and is attached to the cover pivotally around the shaft; when the retainer abuts the retainer catch, a center of the shaft is placed so as to be closer to the bearing region than is the shortest line linking a tip of the first bearing portion and a tip of the second bearing portion.

10 Claims, 4 Drawing Sheets

LIQUID TANK HOLDING MECHANISM

BACKGROUND OF THE INVENTION

1. Field of the Invention

The present invention relates to a liquid tank holding mechanism detachably mounted on a liquid ejection apparatus and adapted to contain and hold a liquid such as ink.

2. Description of the Related Art

A liquid ejection apparatus supplies a liquid to a print head by installing a liquid tank directly on the print head or mounting the liquid tank on a liquid tank mount connected to the print head through a tube or the like. As a mechanism for holding a liquid tank at a predetermined position, a configuration disclosed in Japanese Patent Application Laid-Open No. 2008-110577 is known. In this configuration, the liquid tank biased in a detaching direction by a first spring when mounted is held at a predetermined position by a lever provided on a holder. More specifically, the lever provided on the holder is equipped with a lock protruding toward the liquid tank and configured to be able to pivot on an axis orthogonal to a disengaging direction of the liquid tank, with the lock being biased toward the liquid tank by a second spring. When the liquid tank is mounted, the lock is engaged with part of the liquid tank, thereby holding the liquid tank in a predetermined location. In disengaging the liquid tank, the engagement between the lock and liquid tank is released by application of a force acting against biasing toward the lock, thereby disengaging the liquid tank by biasing in the disengaging direction.

To implement a lever mechanism such as described above using an easy-to-assemble configuration, it is conceivable to configure part of a bearing portion of a cover surrounding a pivot shaft of the lever to be movable in a plane orthogonal to the pivot shaft. More specifically, the bearing portion is divided into two parts and the bearing portion itself or a root of the bearing portion is made flexible and movable in either or both of the two parts. With such a configuration, during assembly of the lever, the bearing portion moves to allow the pivot shaft of the lever to be assembled, and after the assembly, the bearing portion becomes able to hold the pivot shaft of the lever by returning to such a position as to surround the lever shaft.

However, in a configuration in which part of the bearing portion is movable, when an inertial force in the disengaging direction is produced on the liquid tank due to a drop or other shock, a force tending to disengage the liquid tank acts on the lock of the lever, and consequently there is a fear that the lever shaft may come off the bearing portion. When the lever comes off the bearing portion, due to the inertial force produced on the liquid tank and the biasing in the disengaging direction the liquid tank will come off the cover.

SUMMARY OF THE INVENTION

A liquid tank holding mechanism for detachably holding a liquid tank to a main body portion, including a biasing member, a cover and a lever, wherein: the biasing member biases the liquid tank in a disengaging direction with the liquid tank mounted; the lever includes a lock adapted to hold the liquid tank at a predetermined position by getting engaged with the liquid tank, a biasing portion adapted to bias the lock so as to get engaged with the liquid tank, a shaft configured to intersect in a disengaging direction of the liquid tank, and a retainer and is attached to the cover pivotally around the shaft; the cover includes an opening through which the liquid tank is detachably attached, a first bearing portion and a second bearing portion adapted to accept the shaft of the lever, and a retainer catch; the first bearing portion and the second bearing portion movably receive the shaft in a mounting direction or the disengaging direction of the liquid tank in a bearing region formed by the first bearing portion and the second bearing portion, and the bearing portion and/or a root of the bearing portion have flexibility and deform so as to expand spacing between the first bearing portion and the second bearing portion, thereby allowing the shaft to be attached; the retainer catch is configured to abut the retainer to stop movement of the shaft in the disengaging direction of the liquid tank in the bearing region; and when the retainer abuts the retainer catch, a center of the shaft is placed so as to be closer to the bearing region than is the shortest line linking a tip of the first bearing portion and a tip of the second bearing portion.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1A:
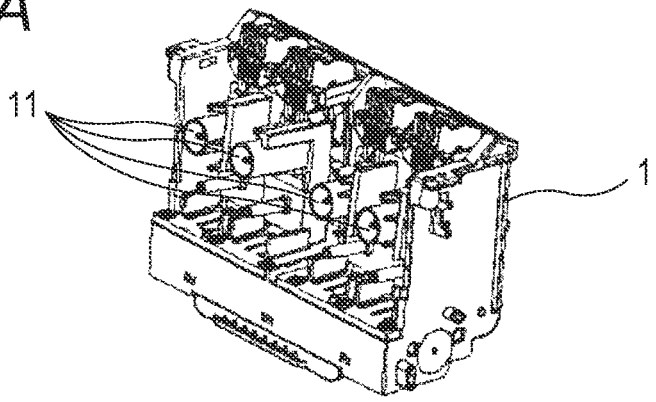
FIGS. 1A, 1B and 1C are perspective views of a liquid tank holding mechanism according to the embodiment of the present invention.
Figure 1B:
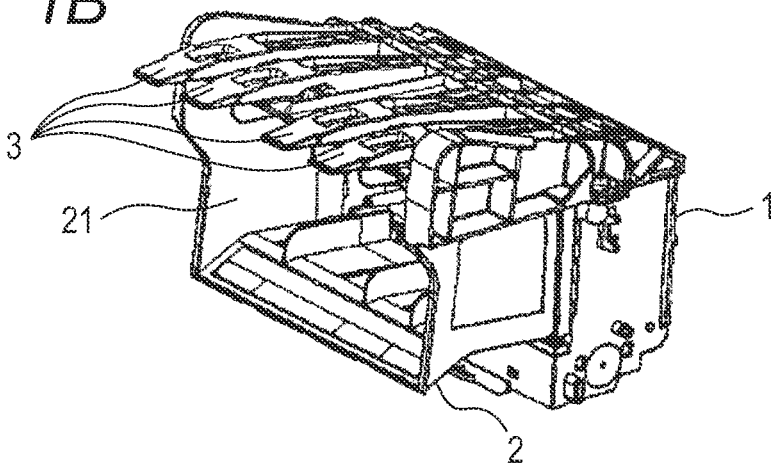
Figure 1C:
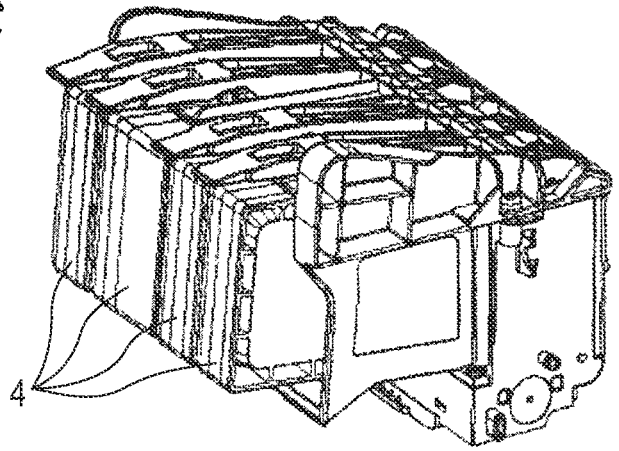

FIGS. 1A to 1C are perspective views illustrating a configuration of an embodiment of a liquid tank holding mechanism according to the present invention.

According to the present embodiment, a liquid tank 4 is mounted and held on a liquid ejection head 1, which is a main body portion. As illustrated in FIGS. 1A and 1B, a cover 2 is attached to the liquid ejection head 1, and a lever 3 is attached to the cover 2. As illustrated in FIG. 1C, plural liquid tanks 4 can be mounted in the cover 2 through an opening 21. The mounted liquid tanks 4 are positioned in each direction excluding a mounting direction using a positioning portion (not illustrated) provided on the liquid ejection head 1 or cover 2. A biasing member 11 adapted to bias the mounted liquid tank 4 in the disengaging direction is attached to the liquid ejection head 1.

Figure 2A:
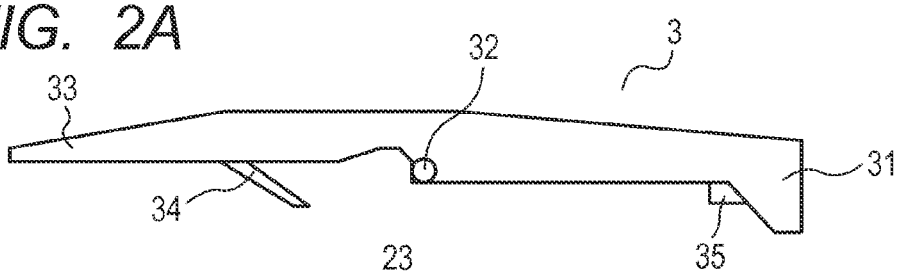
FIGS. 2A, 2B and 2C are schematic diagrams of the liquid tank holding mechanism according to the embodiment of the present invention.
Figure 2B:
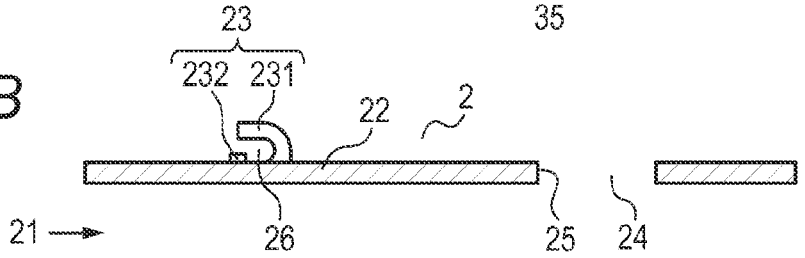
Figure 2C:
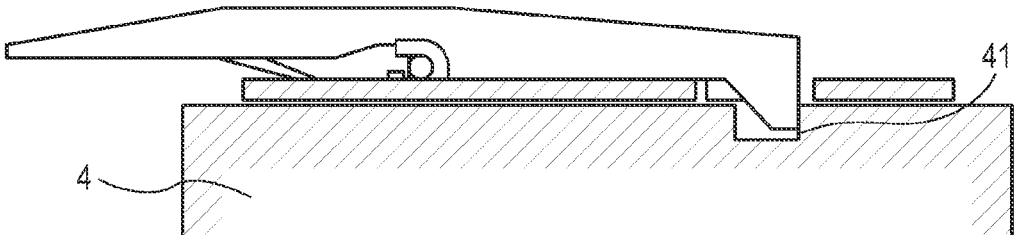

FIG. 2A is a schematic diagram of the lever 3 according to the present embodiment. Also, FIG. 2B is a schematic sectional view of the cover 2 according to the present embodiment in the vicinity of the lever 3 while FIG. 2C is a schematic sectional view illustrating a state in which the lever 3 is attached to the cover 2 and the liquid tank 4 is mounted. The lever 3 can pivot around a shaft 32 and all FIGS. 2A to 2C are diagrams viewed from a direction parallel to the mounting direction of the liquid tank 4 and orthogonal to the pivot shaft of the lever 3.

In mounting the liquid tank 4 illustrated in FIG. 2C, a lock 31 provided at one end of the lever 3 by being shaped to protrude toward the liquid tank 4 gets engaged with a lock catch 41 which is a recess provided on the liquid tank 4. As a result of the engagement, the position of the liquid tank in the mounting direction is determined, and the liquid tank 4 is held in a state of readiness to supply liquid to the liquid ejection head 1.

The cover 2 and lever 3 are formed by resin injection molding. The lever 3 includes the lock 31 and the shaft 32 provided at one end as well as an operating portion 33, a biasing portion 34 and a retainer 35 provided at another end, where the retainer 35 is a characteristic part of the present invention. The cover 2 includes an opening 21, base 22, bearing portion 23, lock inlet 24 and retainer catch 25, which is a characteristic part of the present invention. The bearing portion 23 is made up of a first bearing portion 231 and a second bearing portion 232.

Figure 3A:
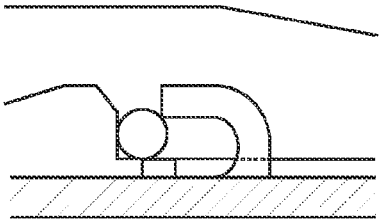
FIGS. 3A, 3B and 3C are schematic diagrams of the liquid tank holding mechanism according to the embodiment of the present invention.
Figure 3B:
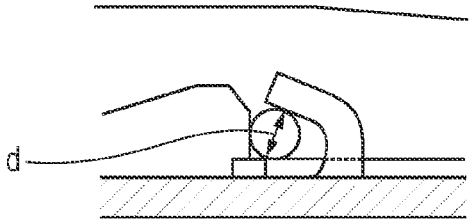
Figure 3C:
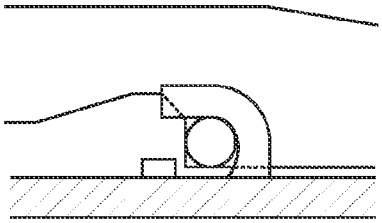

FIGS. 3A to 3C are diagrams illustrating step by step how the shaft 32 is inserted into the bearing portion 23. The first bearing portion 231 and second bearing portion 232 of the cover 2 are placed on the base 22. The first bearing portion 231, second bearing portion 232 and base 22 surround and thereby form a bearing region 26. The bearing region 26 movably receives the shaft 32 of the lever 3 in the mounting direction or disengaging direction of the liquid tank 4, being sized to allow the lever 3 to pivot. Also, a distance d between a tip portion of the first bearing portion 231 and a tip portion of the second bearing portion 232 is set to be smaller than the diameter of the shaft 32 of the lever 3, and thus the lever 3 does not come off in normal use. The first bearing portion 231 has flexibility and thus can be deformed by being pushed by the shaft 32 of the lever 3 as illustrated in FIGS. 3A to 3C when the shaft 32 is inserted into the bearing portion 23. At the time of insertion, the distance d is temporarily made larger than the diameter of the shaft 32, allowing the shaft 32 to be attached.

The shaft 32 of the lever 3 stretches in a direction orthogonal to the mounting direction of the liquid tank 4 and the lever 3 can pivot around the shaft 32 with the shaft 32 attached to the bearing portion 23 of the cover 2. The lock 31 is provided in an end portion (right-side portion in FIG. 2A) away from the shaft 32 in the mounting direction of the liquid tank 4 while the biasing portion 34 is provided on the side away from the shaft 32 in the disengaging direction of the liquid tank 4 (left-side portion in FIG. 2A). The biasing portion 34 is a resin spring formed integrally with the lever 3 and when the liquid tank 4 illustrated in FIG. 2C is mounted, the biasing portion 34 is bent and deformed by the base 22 of the cover 2, producing a force tending to rotate the lever 3 clockwise around the shaft 32. Consequently, the lock 31 is biased toward the liquid tank 4 by the biasing portion 34 and brought into engagement with the lock catch 41, holding the liquid tank 4 at a predetermined position. In disengaging the liquid tank 4, when the operating portion 33 is pressed downward in FIG. 2C, the engagement between the lock 31 and lock catch 41 is released, allowing the liquid tank 4 to move in the disengaging direction by the action of the biasing member 11 provided on the liquid ejection head 1.

Next, a lever retainer mechanism, which is a characteristic part of the present invention, will be described. In the present embodiment, as illustrated in FIG. 2A, the retainer 35 for the lever 3 is provided at a location continuous with the lock 31 in the disengaging direction of the liquid tank 4. Also, the retainer catch 25 is provided in the cover 2. The retainer catch 25 is formed as a hole or concave shape in the cover 2, and placed so as to be spaced away from the retainer 35 by a predetermined distance when the liquid tank 4 illustrated in FIG. 2C is mounted. The predetermined distance satisfies the two conditions described below. The first condition is intended to stabilize an engaged state of the liquid tank 4 while the second condition is intended to produce retaining action when a strong force tending to disengage the liquid tank 4 is applied to the lock 31 of the lever 3.

The first condition is that the retainer 35 and retainer catch 25 do not abut with each other within a movable range of the shaft 32 of the lever 3 in the bearing region 26. If such a distance is established, pivoting of the lever 3 is not hindered by interference between the retainer 35 and retainer catch 25. Also, when the lever 3 is biased in a non-engaged state, since the retainer 35 does not run onto the base 22 of the cover 2, stable operation is possible even if the liquid tank 4 is attached/detached and mounted repeatedly.

Figure 4:
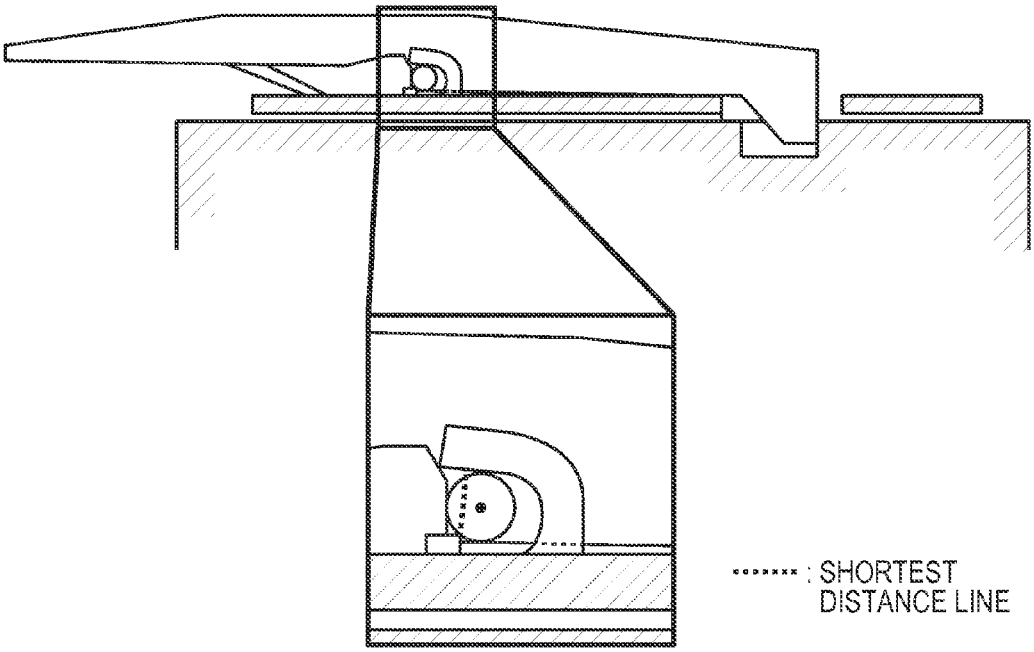
FIG. 4 is schematic diagram of the liquid tank holding mechanism according to the embodiment of the present invention.

The second condition will be described with reference to FIG. 4. The second condition is that in an attitude in which the lock 31 is biased toward the liquid tank 4 and under conditions illustrated in FIG. 4 in which the retainer 35 and retainer catch 25 abut with each other, a center of the shaft 32 is located on the side of the bearing region 26 with respect to the shortest line linking a tip of the first bearing portion 231 and a tip of the second bearing portion 232 (where the shortest line corresponds to the distance d described above and will hereinafter be referred to as the shortest distance line). When the first condition is satisfied since a situation in which the retainer 35 and retainer catch 25 abut with each other is governed by a relationship between the shaft 32 and bearing portion 23, such a situation does not occur in normal use. A situation in which a strong force in the disengaging direction of the liquid tank 4 is applied to the lock 31 of the lever is assumed here rather than a normal use situation. When a strong force in the disengaging direction of the liquid tank 4 is applied to the lock 31 of the lever 3, the shaft 32 receives a force in the disengaging direction of the liquid tank 4 from the lever shaft 32. Consequently, the first bearing portion 231 and/or second bearing portion 232 get deformed in such a direction as to increase the distance d described above. According to the present embodiment, the first bearing portion 231, which is configured to have flexibility, deforms mainly. In so doing, if the shaft 32 goes to the opposite side of the shortest distance line from the bearing region 26, the lever 3 comes off the cover 2. In contrast, when the retainer 35 and retainer catch 25 abut with each other with the shaft 32 being located on the side of the shortest distance line which is closer to the bearing region 26, the movement of the lever 3 in the disengaging direction of the liquid tank 4 stops. Consequently, a restoring force of the deformed bearing portion 23 can make the shaft 32 remain in the bearing region 26.

Figure 5A:
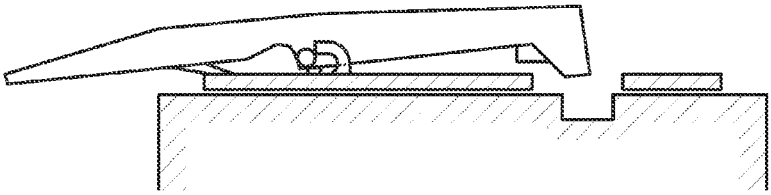
FIGS. 5A, 5B and 5C are schematic diagrams illustrating an assembled state of the liquid tank holding mechanism according to the embodiment of the present invention.
Figure 5B:
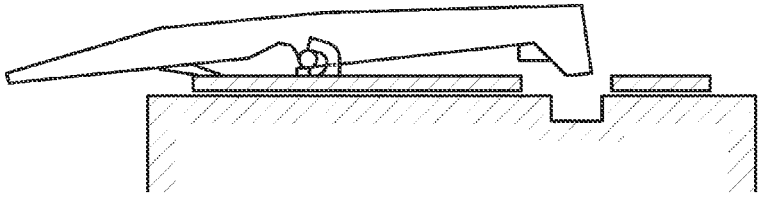
Figure 5C:
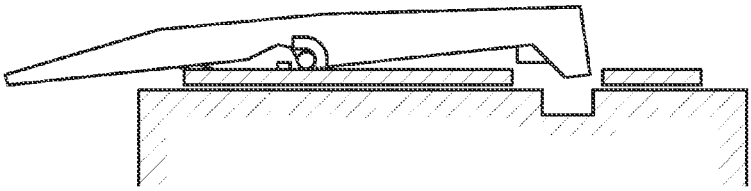

Next, a configuration of the retainer 35 will be described with reference to FIGS. 5A to 5C, where the retainer 35 allows the lever 3 to be assembled easily onto the cover 2. For ease of assembly, it is required that the retainer 35 does not interfere with the cover 2 on a path along which the shaft 32 enters the bearing region 26 by deforming the bearing portion 23. However, when the lever 3 is biased toward the liquid tank 4, a situation in which the retainer 35 interferes with the cover 2 on the path can occur due to the two conditions described above, disabling assembly. Thus, the present invention allows the lever to be assembled easily in the following manner while maintaining the retainer configuration. As illustrated in FIGS. 5A to 5C, the configuration of the present invention involves a positional relationship in which the retainer 35 does not interfere with the cover 2 on the path along which the shaft 32 enters the bearing region 26 by deforming the bearing portion 23 in an attitude in which the biasing on the lock 31 of the lever 3 is reduced.

With the above configuration by inserting the shaft 32 into the bearing region 26 with the bearing portion 23 deformed under a condition of reduced biasing, assembly can be done easily. Also, after the assembly, a liquid tank holding mechanism can be implemented which has a retainer effect against shocks in the disengaging direction of the liquid tank 4.

Although in the present embodiment, the retainer 35 is provided at a location continuous with the lock 31, the retainer 35 may be provided between the shaft 32 and lock 31 independently of the lock 31 or may be provided across the shaft 32 from the lock 31.

Although in the present embodiment, the retainer 35 has a convex shape and the retainer catch 25 is formed as an opening, the retainer 35 may be formed as a concave shape or a wall surface in an opening and the retainer catch 25 may have a convex shape. Also, regarding geometries of the retainer 35 and retainer catch 25, both may have flat surfaces which abut with each other or either or both may have a curved surface such as a pin shape or round-hole shape.

Although in the present embodiment, the retainer 35 and retainer catch 25 have surfaces substantially orthogonal to each other in the disengaging direction of the liquid tank 4, orientations of the surfaces are not limited to this. However, the lever 3 is prone to come off in a configuration in which a force acting in an opposite direction (a force directed upward in FIG. 2C) to the biasing of the biasing portion 34 is produced on the retainer 35 when the retainer 35 and retainer catch 25 abut with each other. Thus, desirably the orientations of the surfaces of the retainer 35 and retainer catch 25 are set such that a force acting in the opposite direction to the biasing of the biasing portion 34 will not be produced.

Figure 6A:
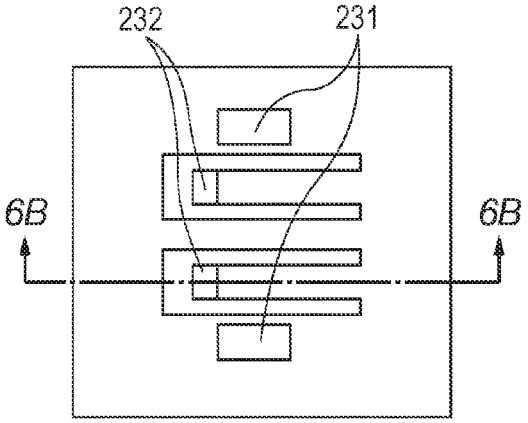
FIGS. 6A, 6B and 6C are schematic diagrams of a liquid tank holding mechanism according to another embodiment of the present invention.
Figure 6B:
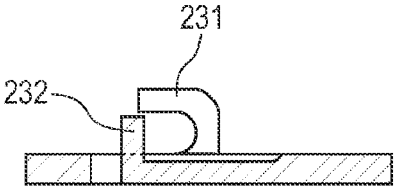
Figure 6C:
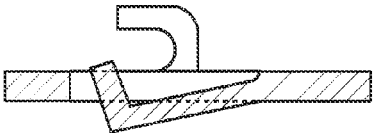

Although in the present embodiment, the first bearing portion 231 is set to have flexibility, the second bearing portion 232 may be configured to have flexibility. In that case, available methods include, for example, a method which involves slitting the base 22 which serves as a root and installing the second bearing portion 232 at a tip of a cantilever or in a midsection of a fixed-fixed beam. FIGS. 6A to 6C are an example of an embodiment in which the second bearing portion 232 is provided at a tip of a cantilever. FIG. 6A is a top view of the structure illustrated in FIG. 2B, FIG. 6B is a sectional view taken along line 6B-6B of FIG. 6A, and FIG. 6C is a diagram illustrating how the second bearing portion 232 is deformed.

Figure 7A:
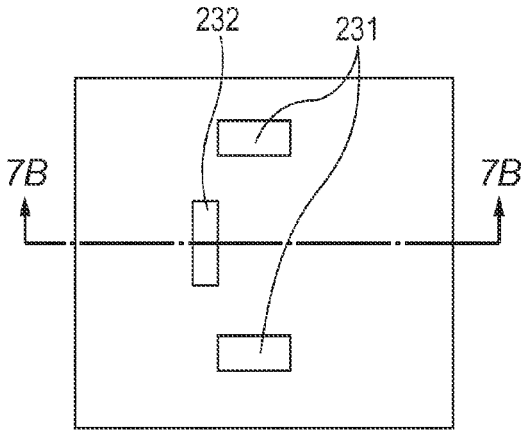
FIGS. 7A, 7B, 7C and 7D are schematic diagrams of a liquid tank holding mechanism according to another embodiment of the present invention.
Figure 7B:
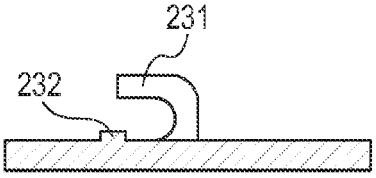
Figure 7C:
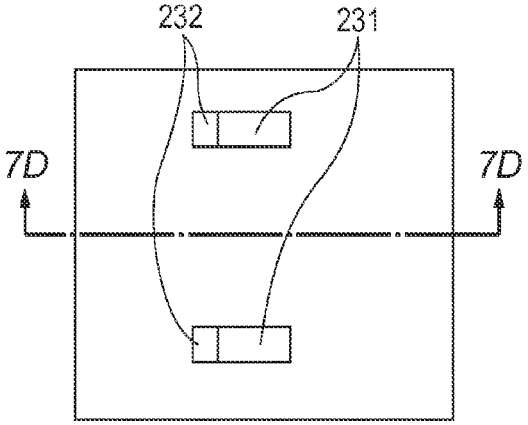
Figure 7D:
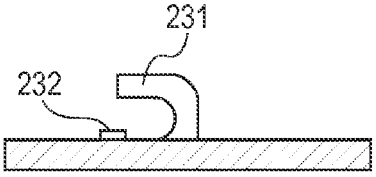

Also, according to the present embodiment, as illustrated in FIG. 7A and FIG. 7B, the first bearing portion 231 and second bearing portion 232 are laid out so as to come into contact with different parts of the shaft, where FIG. 7A is a top view while FIG. 7B is a sectional view taken along line 7B-7B of FIG. 7A. In this case, as illustrated in FIG. 7C and FIG. 7D, the first bearing portion 231 and second bearing portion 232 may be configured to come into contact with the same part of the shaft, where FIG. 7C is a top view while FIG. 7D is a sectional view taken along line 7D-7D of FIG. 7C. According to the present embodiment, the layout illustrated in FIG. 7A allows the cover 2 to be molded without complicating the structure of a mold used to create the cover 2 for use in a configuration in which plural liquid tanks are held.

Although in the present embodiment, the bearing portion 23 is constructed integrally with the cover 2, the bearing portion 23 and cover 2 may be constructed from separate members.

Although in the present embodiment, the liquid tank biasing member 11 is attached to the head 1, the biasing member 11 may be attached to the cover 2 or another member.

Although in the present embodiment, the lever biasing portion 34 is constructed integrally with the lever 3, the biasing portion 34 may be constructed from a separate member. Also, as long as the lock 31 can be biased in such a direction as to be inserted into the lock catch 41 on the liquid tank 4, the biasing portion 34 may be installed at a location other than the location according to the present embodiment and may be constructed from any of various springs such as a compression spring, tension spring, and torsion spring. Also, the biasing portion 34 may be constructed integrally with the cover 2 or another member or may be attached to the cover 2 or another member. When the lever 3 is constructed from a separate member, after the lever biasing portion 34 is attached to the lever 3 or another member, the lever 3 may be attached to the cover 2 by reducing biasing or the lever 3 may be attached to the cover 2 before the biasing portion is attached.

Although a form in which the liquid tank 4 is mounted and held on the liquid ejection head 1 has been described in the present embodiment, the present invention is not limited to this form. The present invention is also applicable to a case in which the liquid tank 4 is held on a mount separated from the liquid ejection head 1 or a case in which something other than the liquid tank 4 is held. In addition to the liquid ejection apparatus, the present invention is also applicable to a holding mechanism adapted to detachably hold a member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-112190, filed May 30, 2014, which is hereby incorporated by reference herein in its entirety.

What is claimed is:

1. A liquid tank holding mechanism for detachably holding a liquid tank to a main body portion, comprising a biasing member, a cover and a lever, wherein:

the biasing member biases the liquid tank in a disengaging direction with the liquid tank mounted;

the lever includes a lock adapted to hold the liquid tank at a predetermined position by getting engaged with the liquid tank, a biasing portion adapted to bias the lock so as to get engaged with the liquid tank, a shaft configured to intersect in a disengaging direction of the liquid tank, and a retainer and is attached to the cover pivotally around the shaft;

the cover includes an opening through which the liquid tank is detachably attached, a first bearing portion and a second bearing portion adapted to accept the shaft of the lever, and a retainer catch;

the first bearing portion and the second bearing portion movably receive the shaft in a mounting direction or the disengaging direction of the liquid tank in a bearing region formed by the first bearing portion and the second bearing portion, and the bearing portion and/or a root of the bearing portion have flexibility and deform so as to expand spacing between the first bearing portion and the second bearing portion, thereby allowing the shaft to be attached;

the retainer catch is configured to abut the retainer to stop movement of the shaft in the disengaging direction of the liquid tank in the bearing region; and when the retainer abuts the retainer catch, a center of the shaft is placed so as to be closer to the bearing region than is the shortest line linking a tip of the first bearing portion and a tip of the second bearing portion.

2. The liquid tank holding mechanism according to claim 1, wherein the retainer is provided at a location continuous with the lock in the disengaging direction of the liquid tank.

3. The liquid tank holding mechanism according to claim 1, wherein the retainer has a convex shape and the retainer catch is formed as a hole or a concave shape.

4. The liquid tank holding mechanism according to claim 1, wherein the retainer is formed as a hole or a concave shape and the retainer catch has a convex shape.

5. The liquid tank holding mechanism according to claim 1, wherein the retainer is placed on an opposite side of the lock from the shaft.

6. The liquid tank holding mechanism according to claim 1, wherein in an attitude in which biasing of the biasing portion is reduced or released, the retainer does not interfere with the cover on a path along which the shaft is assembled by deforming the bearing portion.

7. The liquid tank holding mechanism according to claim 1, wherein a surface of the retainer and a surface of the retainer catch are configured such that a force acting in a direction opposite to the biasing of the biasing portion will not be produced on the retainer when the retainer and the retainer catch abut with each other in an attitude in which bias is applied by the biasing portion.

8. A liquid tank holding mechanism for detachably holding a liquid tank to a main body portion, comprising a biasing member, a cover and a lever, wherein:

the biasing member biases the liquid tank in a disengaging direction with the liquid tank mounted;

the lever includes a lock adapted to hold the liquid tank at a predetermined position by getting engaged with the liquid tank, a biasing portion adapted to bias the lock so as to get engaged with the liquid tank, a shaft configured to intersect in a disengaging direction of the liquid tank, and a retainer and is attached to the cover pivotally around the shaft;

the cover includes an opening through which the liquid tank is detachably attached, a first bearing portion and a second bearing portion adapted to accept the shaft of the lever, and a retainer catch;

the first bearing portion and the second bearing portion movably receive the shaft in a mounting direction or the disengaging direction of the liquid tank in a bearing region formed by the first bearing portion and the second bearing portion, and the bearing portion and/or a root of the bearing portion have flexibility and deform so as to expand spacing between the first bearing portion and the second bearing portion, thereby allowing the shaft to be attached;

the retainer catch is configured to abut the retainer to stop movement of the shaft in the disengaging direction of the liquid tank in the bearing region; and when the retainer abuts the retainer catch, a center of the shaft is placed in the bearing region.

9. The liquid tank holding mechanism according to claim 8, wherein the bearing region is surrounded by the cover, the first bearing portion and the second bearing portion.

10. The liquid tank holding mechanism according to claim 8, wherein one of the retainer and the retainer catch has a convex shape and the other has a concave shape.

* * * * *